US005125667A

United States Patent [19]

Richards

[11] Patent Number: 5,125,667

[45] Date of Patent: Jun. 30, 1992

[54] METHOD OF PLAYING A CARD GAME BASED ON ODD NUMBERS

[76] Inventor: Jerry C. Richards, 629 Pipkin Rd., Jackson, Tenn. 38305

[21] Appl. No.: 684,556

[22] Filed: Apr. 12, 1991

[51] Int. Cl.[5] ..... A63F 1/00
[52] U.S. Cl. ..... 273/303; 273/292
[58] Field of Search ..... 273/292, 303-306

[56] References Cited

U.S. PATENT DOCUMENTS

| | | | |
|---|---|---|---|
| 952,939 | 3/1910 | Parker | 273/303 |
| 957,105 | 5/1910 | Russell | 273/306 |
| 1,526,597 | 2/1925 | Harris | 273/303 |
| 1,629,256 | 5/1927 | Cohen | 272/303 |
| 1,982.534 | 11/1934 | Parker | 273/306 |

OTHER PUBLICATIONS

Games with Playing Cards Plus Tricks and Stunts by Joseph Leeming, Franklin Watts, Inc, 1949, pp. 64-66, 117-129.

Hoyle's Simplified Guide to the Popular Card Games by Walter Gibson, Doubleday & Company, Inc, 1963, pp. 72-86.

*Primary Examiner*—Benjamin Layno
*Attorney, Agent, or Firm*—Terry M. Gernstein

[57] ABSTRACT

A card game uses cards having a plurality of colors and face values, with all face values being odd numbers. Cards are assigned point and score values based on the face value and the color and a trump color as designated by one player. Various games are disclosed all being based on the odd number used for the card face values.

6 Claims, 2 Drawing Sheets

PLAYERS

| AMOUNT BID AND PLAYER | EACH DEAL PLAYED | 1 GAME 1 | 1 GAME 2 | 2 GAME 1 | 2 GAME 2 | 3 GAME 1 | 3 GAME 2 | 4 GAME 1 | 4 GAME 2 | 5 GAME 1 | 5 GAME 2 | 6 GAME 1 | 6 GAME 2 |
|---|---|---|---|---|---|---|---|---|---|---|---|---|---|
| 65 | #2 | 1st HAND | X | 3 | | | 9 | | | | | | |
| | | 2nd HAND | | | | | 5 | | | | | | |
| | | | | | | | 7 | | | | | | |
| | | | | | | | 11 | | | | | | |
| | | | | | | | 9 | | | | | | |
| | | | | | | | 7 | | | | | | |
| | | | | | | | 5 | | | | | | |
| | | | | | | | 11 | | | | | | |
| | | | | | | | 15 | | | | | | |
| | | | | | | | 7 | | | | | | |
| | | | | | | | 9 | | | | | | |
| | | | | | | | 5 | | | | | | |

20

FIG. 5

METHOD OF PLAYING A CARD GAME BASED ON ODD NUMBERS

TECHNICAL FIELD OF THE INVENTION

The present invention relates to the general art of games, and to the particular field of card games.

BACKGROUND OF THE INVENTION

Games of chance and skill have been long known in the art. These games have included card games of many types. Some of these card games are strongly influenced by chance, and some are strongly controlled by the skill of the players. Some of the known card games involve a combination of skill and chance in which a player wins if he can capitalize on the opportunities provided to him by chance. While card known games are extremely popular, there is always room for improvement.

One area that can be improved is the play involved with the discards. Many people do not participate in a card game because they are afraid to play. One of the fears that prevents someone from participating in a card game is the fear of playing the wrong card at the wrong time thereby upsetting their partner or preventing completion of a portion of the game. This fear is fairly common in games such as bridge. This fear often prevents youngsters participating in an otherwise enjoyable game with adults.

While there are many games that have a substantially reduced probability of playing an erroneous card, such games often require such little skill as to be uninteresting to adults and only interesting to small or young children.

Therefore, there a need for a card game in which the likelihood of playing an erroneous card during the game is considerably reduced from present games. However, there is a need for such a game that still remains enjoyable and challenging for both youngsters and adults.

OBJECTS OF THE INVENTION

It is a main object of the present invention to provide card game in which the likelihood of playing an erroneous card during the game is considerably reduced from present games.

It is another object of the present invention to provide a card game in which the likelihood of playing an erroneous card during the game is considerably reduced from present games that still remains enjoyable and challenging for both youngsters and adults.

It is another object of the present invention to provide a card game that can be played by people of all ages.

It is another object of the present invention to provide a card game that can be played by individuals or partners.

SUMMARY OF THE INVENTION

These, and other, objects are achieved by a method of playing cards that permits any particular discard play to be used by other players in reaching the winning goals in the game. The cards are given values that can be used in any play, and the game can proceed toward conclusion from various directions so winning of the game will ultimately be achieved no matter what discard any particular player plays during the game.

BRIEF DESCRIPTION OF THE DRAWING FIGURES

FIG. 5 is a scorecard used in the game of the present invention.

DETAILED DESCRIPTION OF THE PREFERRED EMBODIMENT OF THE INVENTION

Figure 1:
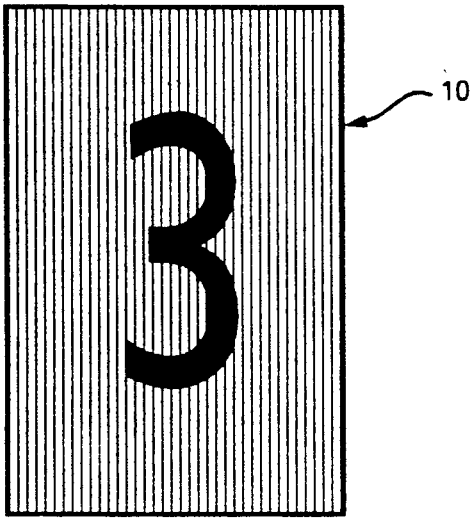
FIG. 1 is a face view of a card used in the game of the present invention.
Figure 2:
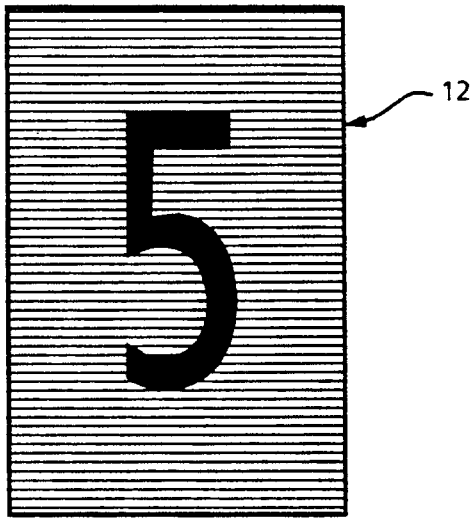
FIG. 2 is a face view of another card used in the game of the present invention.
Figure 3:
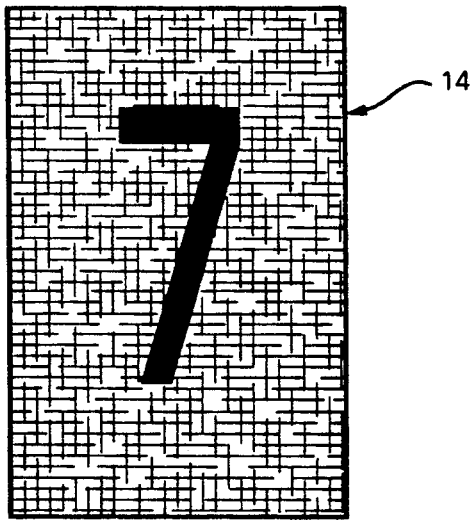
FIG. 3 is a face view of another card used in the game of the present invention.
Figure 4:
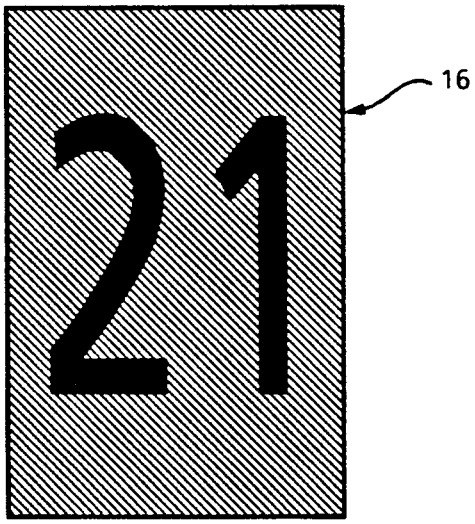
FIG. 4 is a face view of another card used in the game of the present invention.

Shown in FIGS. 1–4 are cards 10, 12, 14 and 16 used in the card game of the present invention. The cards are stored in a deck and there are fifty-seven cards of four different colors, including red card 10, blue card 12, yellow card 14 and green card 16. The cards are numbered 1, 3, 5, 7 and 9. There are three red cards of each number, three blue cards of each number, five cards of each number that are yellow. There is one green card numbered "11" and one green numbered "21", and these cards can also be considered to be wild cards. The entire deck is used for all variations of the card game. The numbers on each card are the face value of such card, and the face values of the cards, along with the colors are used to determine a point value for scoring purposes of each card.

In one game, there are 131 possible points, and points are determined by counting the point values of the cards. The highest card number "21" has a point value of 21 points; the second highest card number "11" has a point value of 11 points, the third highest cards are "9", "7", "5", "3" and "1" of trumps; the fourth highest cards are "9", "7", "5", "3" and "1" of a color played other than trumps. The cards numbered "7" and "9" have point values of 3 points each, cards numbered "5", "3" and "1" have point values of 1 point each. The cards scored in this manner total 131 points.

In a first form of the game, each player receives 13 cards, with at least 5 cards being left in the middle of the players turned face down. These five cards are known as the highest bidder's score pile. The dealer bids the point value that he thinks he can achieve by the end of the game. This point value is his bid, and must be an odd number, and will be less than 131 since the maximum number of points that can be achieved is 131. Bidding continues in the clockwise direction from the dealer, with each player bidding the number of points that he thinks he can make by the end of the game. Any player who feels that he cannot beat the previous bid, passes and does not make a bid of his own. Bidding continues until three players pass.

The player with the highest bid wins the five cards remaining after the deal so he has a total of 18 cards in his hand. This highest bidder removes any five cards from his hand and places them in a highest bidder's score pile, and names a trump color. Any time a player wins a hand, that player can add the five discards in the highest bidder's score pile to his hand, and replaces these cards by any cards remaining in the player's hand.

A notation is made on a scorecard 20 of the amount each player has bid. Upon completion of the game, this amount will be subtracted from any total points scored by that player during the game.

Play begins with the player on the left of the winning bidder, and continues counterclockwise. The first player discards any card from his hand. The following players play any card from their hand. Colors or trumps led by the initial card discarded by the first player of each hand need not be followed. Thus, any player can discard any card from his hand during a particular hand. The player discarding the highest card as determined according to the hierarchy described above wins the hand. If two players discard the same card, and that same card is the highest card played for the particular hand, the first player to play the card wins the hand. The discarded cards are removed from play.

Each hand winner totals the points from the trick won according to the hierarchy described above and wins the highest bidder's score pile. The points won by the hand winner are recorded for that winner. The winning player then can use the five cards from the highest bidder's score pile to replace five cards in his hand. The winner of each hand begins play for the next hand by discarding a card from his hand. Trump color does not change. Play continues until one player reaches 399 points.

Teams can be selected, with each player playing as above described, but the player's hands are totalled according to teams. When one team achieves 399 points, that team wins the game.

Another game uses 55 cards, with wild cards "11" and "21" being omitted, and only red, blue and yellow cards being used. There are eleven cards numbered "1", "3", "5", "7" and "9", with three of each face value being red, three of each face value being blue and five of each face value being yellow cards. This form of the game is played to a point total of 99, with the first player to achieve 99 or having the highest number of points over 99 on the last hand played being the winning player.

Scoring points are determined according to card groupings. Scoring points are awarded as follows: 1 point for three cards of the same face value; 3 points for three cards of the same face value plus two cards having the same face value; 5 points for four cards having the same face value; 7 points for five cards having the same face value; 9 points for a group of cards containing "1", "3", "5", "7" and "9" of any color; and 11 points for a group of cards containing "1", "3", "5", "7" and "9" of the same color.

Five cards are dealt to each player to begin play. After the initial dealing of cards, each player may request up to three new cards from the dealer, and then must discard the same number of cards as requested. Play moves clockwise from the dealer.

After each player has received and discarded cards, each player totals the points in his hand according to the hierarchy discussed above. The player with the highest point total wins the hand. The player with the winning hand receives a bonus of 5 points, unless there is a tie, in which case neither tieing players receives the bonus points, and only receives credit for the points in his hand. The points credited to the winning player or players are recorded on the scorecard 20. If desired, the game can include tie breakers, such as highest individual card in a player's hand, color hierarchy (for example, red being the highest color, blue next and yellow lowest value) so if two players are still tied after determining the highest card face value, the colors of those high face value cards can be used to break ties.

A still further game also uses the same 55 cards just described above. Each player receives 7 cards. The cards remaining after the deal are placed face down and the top card is turned face up.

Play begins with the first player on the dealer's left and continues in that direction. The first player discards all of the cards in his hand that match (either in color or in face value) the upturned card on the deck. If that player does not have any cards that match the face-up player, he draws a card from the face-down deck. After playing his cards, the player turns the next face-down card over, and the next player must match that card, and so forth. Any points remaining in a player's hand after one player has gone out, that is discarded all cards from his hand, are subtracted from that player's point total. The card values are the face values of the cards (for example, card 5 has a value of 5 points, card 3 has a face value of 3 points and so forth). If suitable, if the game is played in partners, the partner of the player going out need not subtract the points remaining in his hand from the total points credited to the team. The points are totaled after each hand, with a hand being completed when one player goes out by discarding all of the cards of his hand. Point totals are accumulated, and the first player or team to accumulate 99 points wins the game. If no player has gone out when the entire face-down deck has been turned face-up, and the last card has been played from one of the player's hand, all players must subtract the points remaining in their hand from their own point total or from the team point total.

It is understood that while certain forms of the present invention have been illustrated and described herein, it is not to be limited to the specific forms or arrangements of parts described and shown.

I claim:

1. A method of playing a card game comprising:

A) providing a deck of fifty-seven cards, with said cards including cards having face values of 1, 3, 5, 7 and 9, and being of four different colors, including three red cards of each face value, three blue cards of each face value, three yellow cards of each face value, one green card of face value "9", and one green card of face value "11";

B) dealing 13 cards to each player;

C) leaving five cards for a highest bidder's score pile;

D) defining a score value for each card, with cards having face values of "9" and "7" having score values equal to 3 points, cards having face values of "5", "3" and "1" having a score value of 1 point, said card having a face value of "21" having a score value of 21, and said card having a face value of "11" having a score value of 11;

E) each player bidding a bid score value based on score value of the cards dealt to such player;

F) each player passing when such player is finished bidding his highest point total;

G) continuing bidding until all but one player has passed, said one player being highest bidder;

H) said one player defining a trump color;

I) defining a hierarchy of card values, which includes (1) said card with a face value of "21" being highest in card value with a value of 21, (2) said card with a face value of "11" being second highest with a value of 11, and (3) said trump color cards having face values of "9", "7", "5", "3" and "1" being next highest;

J) said highest bidder integrating cards from said highest bidder's score pile into cards in said highest bidder's hand and reforming the highest bidder's score pile;

K) said highest bidder playing one card from his hand;

L) a player adjacent to said highest bidder playing one card from his hand;

M) each player playing one card from his hand until all players have played one card from their hand;

N) determining a hand winner by designating the player who played card with the highest card value;

O) crediting the hand winner with a total score determined by adding up the score value of all of the cards played by each player;

P) having said hand winner integrate cards from said re-formed highest bidder's score pile into his hand, and re-forming said re-formed highest bidder's score pile with cards from his hand; and Q) said hand winner playing one card from his hand to begin a new hand.

2. The method of playing a card game define in claim 1 wherein all cards played during a hand are kept in a discard pile and are not replaced into any player's hand.

3. The method of playing a card game define in claim 2 wherein play continues until all players have discarded all of their cards.

4. The method of playing a card game define in claim 3 wherein a winner is designated as being the player with the highest point total when all players have discarded all of their cards.

5. The method of playing a card game defined in claim 4 wherein each player failing to achieve a point total equal to or greater than his bid score value has his bid score value deducted from his point total.

6. The method of playing a card game define in claim 5 further including designating a winner as the first player to reach a score of 399.

* * * * *